US010202723B2

(12) United States Patent
Sun et al.

(10) Patent No.: US 10,202,723 B2
(45) Date of Patent: Feb. 12, 2019

(54) METHOD OF TREATING POLYESTER TEXTILE

(71) Applicant: Novozymes A/S, Bagsvaerd (DK)

(72) Inventors: Ting Sun, Beijing (CN); Weijian Lai, Beijing (CN); Yucheng Zhou, Beijing (CN)

(73) Assignee: Novozymes A/S, Bagsvaerd (DK)

( * ) Notice: Subject to any disclaimer, the term of this patent is extended or adjusted under 35 U.S.C. 154(b) by 14 days.

(21) Appl. No.: 15/535,928

(22) PCT Filed: Dec. 30, 2015

(86) PCT No.: PCT/CN2015/099642

§ 371 (c)(1),
(2) Date: Jun. 14, 2017

(87) PCT Pub. No.: WO2016/107567

PCT Pub. Date: Jul. 7, 2016

(65) Prior Publication Data

US 2017/0342656 A1 Nov. 30, 2017

(30) Foreign Application Priority Data

Dec. 31, 2014 (WO) ..... PCT/CN2014/095808

(51) Int. Cl.

| | |
|---|---|
| ***D04B 1/14*** | (2006.01) |
| ***D06P 3/82*** | (2006.01) |
| ***D06P 1/38*** | (2006.01) |
| ***D06M 16/00*** | (2006.01) |
| ***D06P 1/00*** | (2006.01) |
| ***D06P 1/16*** | (2006.01) |
| *D06P 3/54* | (2006.01) |
| *D06P 3/66* | (2006.01) |
| *D06P 5/04* | (2006.01) |

(52) U.S. Cl.

CPC ..... *D06P 3/8252* (2013.01); *D04B 1/14* (2013.01); *D06M 16/003* (2013.01); *D06P 1/0004* (2013.01); *D06P 1/16* (2013.01); *D06P 1/38* (2013.01); *D06P 3/54* (2013.01); *D06P 3/66* (2013.01); *D06P 5/04* (2013.01)

(58) Field of Classification Search

CPC ..... D04B 1/14; D06P 1/16; D06P 1/38; D06P 1/0004; D06P 3/8252; D06P 3/66; D06P 3/54; D06M 16/003

See application file for complete search history.

(56) References Cited

U.S. PATENT DOCUMENTS

| | | | |
|---|---|---|---|
| 3,767,356 A | 10/1973 | Turner | |
| 5,827,719 A | 10/1998 | Sandal | |

FOREIGN PATENT DOCUMENTS

| | | | | |
|---|---|---|---|---|
| CN | 103556376 A | * | 2/2014 | ..... D04B 1/14 |
| GB | 1428379 | | 8/1972 | |
| WO | 1996022416 A1 | | 7/1996 | |
| WO | 96/29397 A1 | | 9/1996 | |
| WO | 97/27237 A1 | | 7/1997 | |
| WO | 01/34899 A1 | | 1/1999 | |
| WO | 99/01604 A1 | | 1/1999 | |
| WO | 01/92502 A1 | | 12/2001 | |
| WO | 03/040459 A1 | | 5/2003 | |
| WO | 2004/059075 A1 | | 7/2004 | |
| WO | WO 2004/059075 A1 | * | 7/2004 | ..... D06M 16/00 |
| WO | 2010/076388 A1 | | 7/2010 | |

OTHER PUBLICATIONS

English transaltion (Aug. 23, 2018) of the CN Patent No. CN103556376 A.*

* cited by examiner

*Primary Examiner* — Eisa B Elhilo
(74) *Attorney, Agent, or Firm* — Eric J. Fechter

(57) ABSTRACT

Provided is an enzymatic treatment on polyester/cellulose blend textile by contacting the textile with a cutinase and preferable with cellulose as well.

19 Claims, No Drawings

Specification includes a Sequence Listing.

METHOD OF TREATING POLYESTER TEXTILE

CROSS-REFERENCE TO RELATED APPLICATIONS

This application is a 35 U.S.C. 371 national application of international application no. PCT/CN2015/099642 filed Dec. 30, 2015, which claims priority or the benefit under 35 U.S.C. 119 of international application no. PCT/CN2014/095808 filed Dec. 31, 2014. The content of these applications is fully incorporated herein by reference.

REFERENCE TO A SEQUENCE LISTING

This application contains a Sequence Listing in computer readable form, which is incorporated herein by reference.

FIELD OF THE INVENTION

The present invention relates to the method of treating polyester/cellulose blend textile with cutinase.

BACKGROUND OF THE INVENTION

Poly(ethylene terephthalate) abbreviated as PET fibers accounts for the main part of the polyester applied by the textile industry. The fibers are produced by e.g. polycondensation of terephthalic acid and ethylene glycol, and drawing of fibers from a melt.

Polyester has certain key advantages including high strength, soft hand, stretch resistance, stain resistance, machine washability, wrinkle resistance and abrasion resistance. However, polyester is not so optimal in terms of its hydrophobicity, pilling, static, dyeability, inactive surface as a medium for adhering, i.e., softening or wettability enhancing compounds, lack of breathability and undesirable high shine or luster appearance.

Because of its strength, polyester fabrics and/or garments are subject to pill formation, and possibly the most important of the cloth finishing processes applied to polyester staple-fibre materials are those designed for control of pilling. All staple-fibre materials tend to form small balls or "pills" of entangled fibres at the cloth surface, when subjected to mild abrasion during wash and wear. If the fabric contains a substantial proportion of fibres having high resistance to flexural abrasion, the pills may be retained on the surface of the cloth in sufficient numbers to produce an unpleasant handle and appearance.

Another problem with polyester is that during synthesis of PET, cyclic or linear oligomers of poly (ethylene terephthalate), such as terephtalic acid-bis-2-benzoyloxy-ethylesther (BETEB) and/or cyclic tri(ethylene terephthalate) are formed. These oligomers are partly deposited on machinery and partly staying on/in the fibers. Oligomers tend to give fabrics a grayish appearance. This is due to deposits of oligomers on the surface of the fabric, which is particularly outspoken after high temperature wet processes like high temperature dyeing. The oligomers can be removed by severe alkaline treatment, which results in a significant loss of fiber material. Organic extraction of the oligomers is a technical possibility, but not industrially feasible.

To blend polyester and cotton, it makes up the defect of pure polyester which has a poor wearability, in which the most important property is to make a better hydrophilicity from cotton. On the other hand, the polyester inclusion will provide the fabric with higher strength and better quick-drying property. And since the lower price of polyester fiber, the mills would like to include more polyester in their material compared to pure cotton. Hence such blended textile has been used broader in industry.

The industry has made great efforts to improve the characteristics of polyester/cellulose blend.

Cutinase and cellulase can be used to reduce the pilling formation of polyester and cellulose fabric respectively, so as to improve the quality of the fabric.

Cutinases are known from various fungi, such as a filamentous fungal cutinase, e.g. native to a strain of *Humicola* or *Fusarium*, specifically *H. insolens* such as e.g. *H. insolens* strain DSM1800 (U.S. Pat. No. 5,827,719), or *F. solani pisi*. Methods of reducing the pilling propensity of polyester fabrics and/or garments with a terephtalic acid diethyl ester hydrolytic enzyme (ETE hydrolytic enzyme) and/or an ethyleneglycol dibenzyl ester hydrolytic enzyme (BEB hydrolytic enzyme) (WO99/001604), methods for modifying polyester comprising treating polyester with a polyesterase enzyme (WO2001/34899), and enzymatic hydrolysis of cyclic oligomers of poly(ethylene terephthalate), which comprises subjecting the cyclic oligomer to the action of one or more carboxylic ester hydrolases (WO97/27237) have been disclosed.

Cutinase variants have been described such as in WO0192502 wherein *H. insolens* variants have been disclosed for the treatment of polyester textile.

WO9629397 discloses enzyme preparations with performance in industrial applications such as laundry composition, for biopolishing of newly manufactured textiles, and for providing an abraded look of cellulosic fabric or garment.

WO2010/076388 discloses fungal endoglucanases with substantial performance at low temperatures; the endoglucanases are used for treating cellulosic material, especially in textile industry, e.g. in biofinishing or biostoning.

However, there is continuously a need for improved benefit of enzymatic polyester blend fabric and/or garment treatment, including enhancing the efficiency of the enzymes to their substrates. Thus identification of such enzymes with improved properties for use in methods for treating fabrics would be desirable. At the same time process optimization to obtain better performance of enzymes are also being investigated.

SUMMARY OF THE INVENTION

The present invention relates to a method for manufacturing polyester/cellulose blend textile, comprising the following steps:

(a) textile pretreatment, (b) polyester dyeing, (c) cellulosic fiber dyeing, and (d) soaping;

wherein cellulase is added before, during or after step (b), step (c) and/or step (d); and cutinase is added before, during or after step (b), step (c) and/or step (d).

In some embodiments, the polyester/cellulose blend textile is the blend of polyester and cotton, or the blend of polyester and viscose.

DEFINITIONS

Cutinases

Cutinases are lipolytic enzymes classified as EC 3.1.1.74 according to Enzyme Nomenclature. Reference is made to the Recommendations of the Nomenclature Committee of the International Union of Biochemistry and Molecular Biology, Academic Press Inc., 1992.

For purposes of the present invention, cutinase activity is determined using oligomer Terephtalic acid-bis-2-benzoyloxy-ethylesther (BETEB) as substrate according to the testing method in Examples of the present invention. BETEB is a by-product during the PET synthesis and is generally remained in the fabric or garment during textile manufacturing. BETEB is produced by e.g. condensation of terephthalic acid, benzoic acid and ethylene glycol, which has the same unit of benzoyloxy-ethylester as PET.

The enzyme in question qualifies as a cutinase for use according to the present invention if transparent zones are shown after testing according to the method in Examples.

Cutinases are known from various fungi, such as a filamentous fungal cutinase, e.g. native to a strain of *Humicola* or *Fusarium*, specifically *H. insolens* or *F. solani pisi*, more specifically *H. insolens* strain DSM 1800 (U.S. Pat. No. 5,827,719, hereby incorporated by reference), or particularly *F. solani pisi* (WO 90/09446; WO 94/14964, WO 94/03578, all hereby incorporated by reference) or *Magnaporthe grisea* (WO10/107560 SEQ ID NO: 1, hereby incorporated by reference) or *Pseudomonas mendocina* ATCC 53552 (U.S. Pat. No. 5,389,536, claim 1, hereby incorporated by reference).

SEQ ID NO: 1 is the amino acid sequence of the *Humicola insolens* cutinase (corresponding to the mature part of SEQ ID NO: 2 of U.S. Pat. No. 5,827,719).

In one embodiment, the cutinase of the present invention has at least 70%, or 75%, or 85%, or 90%, or 95%, or 96%, or 97%, or 98%, or 99%, or 100% identity to SEQ ID NO: 1.

In some embodiments, the cutinase can be variants comprising a substitution, deletion, and/or insertion of one or more (or several) amino acids of SEQ ID NO: 1. Preferably, the total number of amino acid substitutions, deletions and/or insertions of the SEQ ID NO: 1 is not more than 10, e.g., 1, 2, 3, 4, 5, 6, 7, 8 or 9.

The fungal cutinase may also be derived from a strain of *Rhizoctonia*, e.g. *R. solani*, or a strain of *Alternaria*, e.g. *A. brassicicola* (WO 94/03578). The cutinase enzyme may also be a variant of a parent cutinase such as those described in WO 00/34450, or WO 01/92502.

Sequence Identity

The relatedness between two amino acid sequences or between two nucleotide sequences is described by the parameter "sequence identity".

For purposes of the present invention, the degree of sequence identity between two amino acid sequences is determined using the Needleman-Wunsch algorithm (Needleman and Wunsch, 1970, *J. Mol. Biol.* 48: 443-453) as implemented in the Needle program of the EMBOSS package (EMBOSS: The European Molecular Biology Open Software Suite, Rice et al., 2000, *Trends Genet.* 16: 276-277), preferably version 3.0.0 or later. The optional parameters used are gap open penalty of 10, gap extension penalty of 0.5, and the EBLOSUM62 (EMBOSS version of BLOSUM62) substitution matrix. The output of Needle labeled "longest identity" (obtained using the –nobrief option) is used as the percent identity and is calculated as follows:

(Identical Residues×100)/(Length of Alignment–Total Number of Gaps in Alignment)

For purposes of the present invention, the degree of sequence identity between two deoxyribonucleotide sequences is determined using the Needleman-Wunsch algorithm (Needleman and Wunsch, 1970, supra) as implemented in the Needle program of the EMBOSS package (EMBOSS: The European Molecular Biology Open Software Suite, Rice et al., 2000, supra), preferably version 3.0.0 or later. The optional parameters used are gap open penalty of 10, gap extension penalty of 0.5, and the EDNAFULL (EMBOSS version of NCBI NUC4.4) substitution matrix. The output of Needle labeled "longest identity" (obtained using the –nobrief option) is used as the percent identity and is calculated as follows:

(Identical Deoxyribonucleotides×100)/(Length of Alignment–Total Number of Gaps in Alignment)

Polyester/Cellulose Blend Textile

"Polyester" as used herein means a linear polymeric molecule containing in-chain ester groups and which are derived from the condensation of a diacid with a diol or from the polymerization of hydroxy acids. The present invention applies to both aliphatic and aromatic polyesters. However, particularly preferred are aromatic polyester articles which are used to produce fiber and resin and that comprise a synthetically produced long chain polymer comprising at least 85%, preferably at least 90% and most preferably at least 95%, by weight of an ester of a substituted aromatic carboxylic acid, such as substituted terephthalic acid or parasubstituted hydroxybenzoate. Other useful polyester articles include those made of bulk polymer, yarns, fabrics, films, resins and powders. The principal polyesters in industrial usage include polyethylene terephthalate (PET), tetramethylene terephthalate (PTMT), polybutylene terphthalate (PBT), polytrimethylene terephthalate (PTT) and polyethylenenaphthalate (PEN), polycyclohexanedimethylene terephthalate (CHDMT), poly (ethylene-4-oxybenzoate) A-Tell, polyglycolide, PHBA and 2GN. However, PET is the most common linear polymer produced and accounts for a majority of the polyester applied in industry today.

"Cellulose" as used herein refers to any cellulosic textile, such as cotton, viscose, rayon, ramie, linen, lyocell (e.g., Tencel, produced by Courtaulds Fibers), or mixtures thereof.

Polyester/cellulose blend textile used herein is a mixture of any of cellulose fiber with polyester fiber, such as polyester/cotton blends, polyester/viscose blends, polyester/lyocell blends, polyester/viscose/cotton blends etc. In particular, the polyester is PET.

In one aspect the polyester/cellulose blend fabric is a fabric blend comprising at least 5% (w/w) of polyester, such as at least 10%, at least 20%, at least 30%, at least 40%, at least 50%, at least 55%, at least 60%, at least 65%, at least 70%, at least 75%, at least 80%, at least 85%, at least 90%, or at least 95% of polyester.

The textile used herein is meant to include fibers, yarns, fabrics and garments comprising polyester and cellulose.

Cellulases

The method of the present invention may further include cellulase. In the present context, the term "cellulase" or "cellulolytic enzyme" refers to an enzyme which catalyzes the degradation of cellulose to glucose, cellobiose, triose and other cello-oligosaccharides which enzyme is understood to include a mature protein or a precursor form thereof or a functional fragment thereof, e.g., a catalytic active module, which essentially has the activity of the full-length enzyme. Furthermore, the term "cellulolytic" enzyme is intended to include homologues or analogues of said enzyme. Suitable cellulases include those of animal, vegetable or microbial origin. Microbial origin is preferred. The cellulolytic enzyme may be a component occurring in a cellulase system produced by a given microorganism, such a cellulase system mostly comprising several different cellulase enzyme components including those usually identified as, e.g., cellobiohydrolases, endoglucanases, and beta-glucosidases. In a preferred embodiment the cellulase is an endoglucanase (E.C. 3.2.1.4).

Examples of commercially available cellulase enzyme products useful in the method of the present invention are: Cellusoft CR®, Cellusoft L®, Novoprime A 378® all available from Novo Nordisk A/S, DK-2880 Bagsvaerd, Denmark); Indiage™, Primafast™ (both from Genencor International Inc., U.S.A.); Powerstone™ (from Iogen, Canada); Ecostone™ (from Alko, Finland); Rocksoft™ (from CPN, U.S.A.), and Sanko Bio™ (from Meiji/Rakuto Kasei Ltd., Japan).

Polyester/Cellulose Blend Fabric Manufacturing Process

Polyester such as poly (ethylene terephthalate) is synthesized by condensation, drawn into fibers from a melt, possibly cut to stables, possibly mixed with other fiber types, and spun to yarn.

For polyester/cellulose blended fabric, polyester and cellulose fiber has spun to yarn and then knitted or woven into fabric. Then in the mills the fabric is normally treated to remove spin finish oil, for example in a process where the fabric will first be heat setted at 170/180° C. and then be pretreated with surfactants (sometimes also with addition of alkali) at 80-100° C. and then the polyester part will be dyed with disperse dyestuffs at pH 4.5-6 at up to 135° C., followed by reduction clearing with sodium hyposulphite at 60-80° C., sodium carbohydrate and then rinse if necessary. Then cotton part will be dyed with reactive dyestuff at 50-60° C., pH 6-7 and after reactive dyeing there will be a soaping step.

Disperse dyestuff herein refers to the dyestuffs used for polyester or acetate dyeing; it is usually a class of non-ionic dyes with strong water-soluble free radicals and particle fineness around 1 μm; in the dyeing process it will be sporadic and be wrapped in fiber when dyeing.

Reactive dyestuff herein refers to the dyesfuff used for cotton or other cellulosic fiber dyeing; they usually attach themselves to their substrates by a chemical reaction that forms a covalent bond between the molecule of dye and that of the fiber, eg black 5, red 195, BLUE 19, TQ blue etc.

Soaping process herein refers to a process for the removal of reactive dye hydrolysate from dyeings on cellulosic fibers and their blends, it can be a process either with addition of soaping agent or not. Preferrably, soaping agent (i.e. surfactants) can be added in the soaping step. The soaping agent can be anioinic, cationic or inonic surfactants and its mixtures, eg. LAS, polyacrylic acids or salts, fatty acids or salts, APEO etc. Generally, there will be one, two or three processes of soaping depending on the needs. Soaping solution will be drained during each soaping process.

A softening step can be added after soaping step for better hand feeling of the fabric.

In this invention it has been optimized to make cutinase biopolishing method integrated into the soaping process and maintain the highest performance. In some embodiments, cellulase and cutinase can be combined in soaping process, by which it reached high biopolishing performance and at the same time the biopolishing process has been integrated into the original process without additional bath of the process.

The process of the invention is readily applicable in the textile industry as it can be carried out using existing wet processing apparatus, such as in a beam dyer, a Pad-Roll, a Jigger/Winch, a J-Box, or Pad-Steam types of apparatus. The process preferably takes place during the finishing (post treatment) step.

As used herein, the term "biopolishing", "depilling", "reduction of pilling formation" and "anti-pilling" are interchangeable.

Polyester and cellulose fabrics have a handle appearance that is rather hard and stiff without the application of finishing components. Some fabric surface is not smooth because small fuzzy polyester or cellulose microfibrils protrude from it. In addition, after a relatively short period of wear, pilling appears on the fabric surface thereby giving it an unappealing, worn look.

Biopolishing is a method to treat polyester, or cellulose or polyester/cellulose blend fabrics during their manufacturing, which improves fabric quality with respect to "reducuction of pilling formation". The most important effects of biopolishing can be characterised by less fuzz and pilling, increased gloss/luster, improved fabric handle, increased durable softness, anti-static property and/or improved water absorbency. In the present context, the term "reduction of pilling formation" is intended to mean a resistance to formation of pills on the surface of the treated fabric surface according to the method of the present invention.

For the purpose of the present invention, the pilling formation may be tested according to the description of "pilling notes test" in the material and method section. The results of the test is expressed in terms of "pilling notes" which is a rating on a scale from pilling note 1 (heavy pill formation) to pilling note 5 (no pill formation), allowing ¼ pilling notes.

Since the method of the present invention catalyzes hydrolysis of the polyester fibre surface, the enzymatic action will eventually result in a weight loss of fibre or fabric. In a preferred embodiment, even though the biopolishing is carried out in such a way so as to obtain a controlled, partial hydrolysis of the fibre surface, a proper polishing effect without excessive loss of fabric strength has hitherto been obtained.

Process Condition

In the present invention, cutinase can be used during polyester/cellulose blend textile manufacturing process in combination with soaping step.

In a preferred embodiment, the method of the present invention comprises the following steps: (a) textile pretreatment, (b) polyester dyeing, (c) cellulosic fiber dyeing, and (d) soaping with cutinase.

In some embodiments, the textile pretreatment is conducted in a pH range of 10-14; temperature range of 70-120° C., preferably 100-120° C., more preferably 110-120° C.

It is advised that a suitable liquor/textile ratio to be used in the soaping process may be in the range of from about 20:1 to about 1:1, preferably in the range of from about 15:1 to about 3:1, more preferably in the range of from 15:1 to 5:1 (Volumn/weight, ml/g).

The process temperature in the soaping process of the present invention is preferably selected according to the optimal temperature of the cutinase+/−10° C. Preferably the process is able to function at a temperature below 100° C., preferably below 95° C., more preferably below 90° C.

In some embodiments, the soaping process of the present invention is conducted at the temperature range of 40−100° C., preferably 50-95° C., preferably 60-90° C., more preferably 65-85° C., and even more preferably 70-80° C.

Enzyme dosage greatly depends on the enzyme reaction time, i.e. a relatively short enzymatic reaction time necessitates a relatively increased enzyme dosage, and vice versa. In general, enzyme dosage may be stipulated in accordance with the reaction time available.

The amount of cutinase to be used according to the method of the present invention depends on many factors and should preferably be optimized by the skilled person. According to the present invention the preferred concentration of the cutinase enzyme in the aqueous medium is from about 0.01 to about 50 milligram enzyme protein per gram of polyester textile, preferably 0.05-20 milligram of enzyme protein per gram of polyester textile, more preferably 0.1-15 milligram of enzyme protein per gram of polyester textile, and even more preferably 0.2-5 milligram of enzyme protein per gram of polyester textile.

In some embodiments, a cellulase is added in step (c) and/or (d) for cellulose biopolishing. In a preferred embodiment, the cellulase is an endoglucanase. In some embodiments, both cellulase and cutinase are added in step (c) to achieve the biopolishing effect for the polyester/cellulose blend fabric.

In some embodiments, cellulase and cutinase are added during step (d). In some embodiments, cellulase and cutinase are added after step (d). In some embodiments, cellulase and cutinase are added before step (b) and after step (a). In some embodiments, cellulase and cutinase are added before step (c) and after step (b). In some embodiments, cellulase is added during step (c) and cutinase is added during step (d). In some embodiments, cellulase is added during step (c) and cutinase is added right after step (d).

According to the present invention the preferred concentration of the cellulase enzyme in the aqueous medium is from about 0.01 to about 50 milligram enzyme protein per gram of polyester textile, preferably 0.05-20 milligram of enzyme protein per gram of polyester textile, more preferably 0.1-15 milligram of enzyme protein per gram of polyester textile, and even more preferably 0.2-5 milligram of enzyme protein per gram of polyester textile.

In some embodiment, step (d) is followed by a softening step by using softeners to obtain a good hand feeling and improve the fabric quality such as anti-static or better lubricant; The softeners can be soap, vegetable oil, quaternary ammonium salts with alkyl chains, salts of monoesters and diesters of phosphoric acid and the fatty alcohols; Silicone-based compounds such as polydimethylsiloxane comprise the new softeners which work by lubricating the fibers. Derivatives with amine- or amide-containing functional groups are used as well. To maintain a good biopolishing performance, it is preferably to avoid using the softeners with bulky function. Silicon softeners which have film-forming ability, polyether/polyester which has film-forming ability and Cationic softener quaternary ammonium salts with alkyl chains and other kinds are preferably used in the invention.

EXAMPLES

Enzyme

Cellusoft CR®) (a *Humicola insolens* mono-component endoglucanase product commercially available from Nozozymes A/S);

Cutinase-1: variant of cutinase from *Humicola. Insolens*, with substitutions E6Q+A14P+E47K+R51P+E179Q+G8D+N15D+S48E+A88H+N91H+A130V+R189V on the parent *H. insolens* cutinase of SEQ ID NO:1 (Cutinase-1 described in WO 2001/092502).

Material

Disperse dyestuff: Artelon Scallet SW-XG (commercially available from Argus Shanghai Textile Auxiliary Co., LTD);

Disperse dyestuff: Red S-2GFL (commercially available from Zhejiang Longsheng Chemical Co., LTD);

Reactive dyestuff: Red BF-3B (commercially available from Zhejiang Longsheng Chemical Co., LTD);

Phosphate buffer (PBS buffer): $Na_2HPO_4$, $NaH_2PO_4$ solutions mixed at specific volume to achieve the target pH;

De-oil agent RO-G (commercially available from Argus shanghai Textile Auxiliary CO., LTD);

Leveling agent for disperse dyeing Peregal O25 (commercially available from Hebei Xingtai Kewang Auxiliary agent CO., LTD.);

Soaping agent Dekol SNS (commercially available from BASF);

IPE1310 (surfactant from zhejiang Haian petrochemical plant);

INVADINE CWA (surfactant from Huntsman);

32 s TC 65/35 knit: knitted fabric with 65% PET and 35% cotton (s represents the count of yarn weaving knitted fabric) (commercially available from Shanghai Tiqiao textile and yarn dyeing Co., LTD).

Method

Pilling Note Test

Swatches including treated and untreated which had been pre-conditioned in norm climate (65% humidity, 20° C.) for at least 24 hours were tested for the pilling notes with Nu-Martindale Tester (James H. Heal Co. Ltd, England), with untreated fabrics of the same type as the abraded fabrics. A standard pilling test (Swiss Norm (SN) 198525) was carried out after 2000 Revolutions by marking from 1-5, with the meaning defined as below, where 1 shows poor anti-pilling and 5 shows excellent anti-pilling property. Thus the higher the Martindale pilling notes score the more effective the biopolishing treatment.

Note 5: No pilling

Note 4: Slight Pilling

Note 3: Moderate Pilling

Note 2: Distinct Pilling

Note 1: Heavy Pilling

½, ¼ notes are allowed

Three separate readings were carried out by different persons for each sample, and the average of the three readings was adopted as the final result of pilling notes.

BETEB-Agar Plate for Evaluation of the Cutinase Activity

BETEB was hydrolyzed by cutinase into more soluble agents. Thus, after hydrolysis by enzyme, there were transparent zones on the plates poured with the mixture of Agar and BETEB.

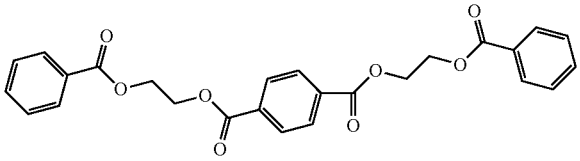

BETED molecule structure

Hydrolysis of BETEB will produce

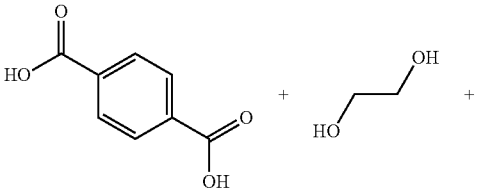

-continued

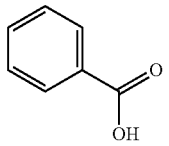

Cutinase activity was measured by the below process:

a) BETEB solution preparation: 5 ml 100% ethanol was added into a glass bottle with a plug, 20 mg BETEB was added into the ethanol and then the bottle was placed in a 60° C. water bath to dissolve the BETEB.

b) 1.5% agar solution was prepared by adding 0.75 g agar into 45 ml Tris-HCl buffer (25 mM, pH 7.0), and then placing the baker in a Microwave oven heating twice for 30 seconds to dissolve the Agar.

c) The agar solution was cooled down to 60° C. and mixed with the BETEB solution prepared in step a). The mixture was poured into a petri dish.

d) Small holes were dug in the petri dish with a tip of 6 mm diameter or puncher.

e) Enzyme sample of 30 microgram/ml was added into the petri dish by a tip with 75 microliter (ul) enzyme sample for each hole. The petri dish was placed at 37° C. overnight.

Cutinase-1 showed transparent zones in the area around the holes, as BETEB was hydrolyzed by the cutinase.

Example 1

Cellulase and Cutinase in One Bath and Combined in Soaping in Launder-O-Meter Small scaled (14 cm*14 cm) fabric of 32 s TC 65/35 knit was treated in Launder-O-Meter (LOM) for biopolishing. Fabric pretreatment was conducted in JFO (Werner Mathis Model JFO Laboratory Jet Dyer) and then fabric was cut into 14 cm*14 cm for polyester disperse dyeing which was carried out in Lab-O-mat (Type BFA Beaker Dyer); followed by reduction clearing and rinse; reactive dyeing of cotton biopolishing was carried out in a SDL-Atlas LP2 Launder-O-Meter (LOM) and followed by soaping. The detailed steps were explained as below:

Step 1. Fabric Pretreatment

First fabric was pretreated in JFO (Mathis Model JFO Laboratory Jet Dyer) to remove the spinning oil or scour and bleach of TC blended fabrics. 1 kg fabric was prepared to a barrel, and then loaded on the device followed by sewing to form a circle. Fabric was arranged in the cavity to make it whirling smoothly.

JFO equipment settings: winch speed 12 m/min, liquor pump 70% of full capacity, turn over 28 seconds. Then start the equipment with 0.4 g/L de-oil agent RO-G, 1 g/L NaOH at 90° C. for 60 min. And then wash at 40° C. for 10 min and then drain out to remove other impurities. Further the fabric was centrifuged and then dried in dryer.

Step 2. Disperse Dyeing, Reduction Clearing and Rinse

Then the fabric was cut into rectangular pieces/swatches of 14 cm×14 cm about 4-5 g for disperse dyeing in Lab-o-mat. The temperature increased from 20° C. to 70° C. at 5° C./min and then increased to 135° C. at 1° C./min; the liquor ratio was 10:1; pH was adjusted with acetic acid to 4.5; 1% owf (on weight of fabric) disperse dyestuff Artelon Scallet SW-XG and 1 g/L leveling agent peregal O25 was added when temperature increased to 40° C.

After disperse dyeing, drain the water and reduction clearing was conducted in the conditions of $Na_2S_2O_4$ (Hydrosulfite) 2 g/L, $Na_2CO_3$ 3 g/L at 70-80° C., 30 min and then followed by rinse at 80° C. for 10 min.

Step 3. Reactive Dyeing

After disperse dyeing, the fabric was colored with dyestuff Red BF-3B at 2% owf at 55° C., pH 7 for 60 min with 80 g/L NaCl. The process was conducted as following: dyestuff and NaCl was first dissolved in the phosphate buffer ($Na_2HPO_4$, $NaH_2PO_4$, pH7) and then one piece was placed in each beaker. Buffer (dyestuff and salt has been dissolved in) were added based on the calculation of actual fabric weights, with a liquid to fabric v/w (ml/mg LR ratio) of 10:1.

Each beaker was fitted with a lid lined with 2 neoprin gaskets and close tightly with the metal clamping device. The beakers were loaded into the LOM preheated to 55° C. If cellulase biopolishing is combined in reactive dyeing then small acid proof steel balls were added for mechanical action. Metal racks were used to accommodate and secure 5 beakers, in the vertical position, in each of the 4 drum positions. The LOM lid was closed and dyeing was conducted. 60 min later the fabric was drained out and moved to the soaping step.

Step 4. Soaping

Soaping was conducted in 90° C. for 10 min with 1 g/L SNS. Usually two process of soaping were conducted for middle and dark shade. In example 1, two baths of soaping were conducted.

Enzyme biopolishing was conducted in LOM with PBS Buffer at LR=10. 0.6% owf Cellusoft CR®, cutinase-1 at 5.6 mg enzyme protein/gram of fabric was added in one bath for 2 hours at 70° C. and pH 7, 0.1 g/L IPE1310 was added. One piece of fabric was placed in each beaker together with 10 small steel balls (diameter 1.5 cm) providing mechanical aid. Enzyme biopolishing was conducted after step 1, after step 2, after step 3 and after step 4 respectively. After two hours enzymatic treatment, the fabric was rinsed, centrifuged, dried and conditioned for anti-pilling evaluation.

TABLE 1

Anti-pilling performance of cutinase and cellulase in one bath (pilling was evaluated after soaping)

| TC 65/35 knit | Untreated | Cellulase and cutinase in one bath after the pretreatment | Cellulase and cutinase in one bath after reduction clearing | Cellulase and cutinase in the reactive dyeing | Cellulase and cutinase in one bath after soaping |
|---|---|---|---|---|---|
| Pilling note (2000R, Martindale) | 1.0 ± 0.2 | 1.8 ± 0.2 | 2.2 ± 0.2 | 2.1 ± 0.1 | 2.8 ± 0.2 |

The untreated group means the fabrics were only dyed without enzyme treatment. In step 3 there was no cellulase added in while in step 4 there were only two ordinary steps of soaping.

When cellulase Cellusoft CR®) and Cutinase-1 were used together in one bath, it was found that the best biopolishing performance was obtained when the biopolishing was conducted at the bath after soaping.

Example 2

Cellulase was Combined in the Reactive Dyeing and Cutinase in the Bath after Soaping (in LOM)

First the fabric pretreatment was conducted in JFO and then fabric of 32s TC 65/35 knit was cut into 14 cm*14 cm for polyester disperse dyeing which was carried out in Lab-O-mat, followed by reduction clearing and rinse; reactive dyeing of cotton was carried out in a SDL-Atlas LP2 Launder-O-Meter (LOM) and followed by soaping. And cutinase biopolishing on small scaled fabric was also conducted in LOM. The detailed steps were the same as steps 1-4 of Example 1.

0.6% owf Cellulase Cellusoft CRC) was combined in reactive dyeing of step 3 and 10 small steel balls were added to each beaker in LOM to provide mechanical action.

Cutinase biopolishing was conducted in the second soaping step as in step 4. It was conducted in LOM with PBS Buffer, LR=10 and Cutinase-1 of 5.6 mg enzyme protein/gram of fabric was added at pH 8 and 70° C., 0.1 g/L IPE1310 was added. One piece of fabric was placed in each beaker together with 10 small steel balls (diameter 1.5 cm) providing mechanical aid. After 2 hours, the fabric was rinsed with water, centrifuged and dried before evaluation.

TABLE 2

Anti-pilling performance when cellulase was combined in reactive dyeing and cutinase was in the bath of second soaping

| TC 65/35 knit | Untreated | Cellulase in reactive dyeing and Cutinase in the bath of second soaping (2 hours) |
|---|---|---|
| Pilling note (2000R, Martindale) | 1.0 ± 0.2 | 3.0 ± 0.2 |

The untreated group means the fabrics were only dyed without enzyme treatment. In step 3 there was no cellulase added in while in step 4 there were only two ordinary steps of soaping.

Example 3

Cellulase and Cutinase in One Bath and Combined in Soaping in JFO 1 kg fabric of 32s TC 65/35 knit was prepared to a barrel with 1 m in width, and then it was loaded on the device in JFO (Werner Mathis Model JFO Laboratory Jet Dyer) followed by sewing to form a circle. Fabric was arranged in the cavity to make it whirling smoothly.

Equipment setting: to set the winch speed at 12 m/min, liquor pump 70% of full capacity, to make a turn over about 28 seconds. The pretreatment, reactive dyeing of cotton part and biopolishing of 1 kg fabric was carried out in JFO while polyester disperse dyeing was carried out in Jet-dyer (ALL-FIT-10). The processes were the same as steps 1-4 of Example 1.

Enzyme biopolishing was conducted in JFO with Buffer ($Na_2CO_3$-HAC, pH7), LR=10. And 0.6% owf Cellusoft CR®, cutinase-1 of 0.4 mg enzyme protein/gram of fabric was added in one bath in the second soaping of step 4. After 1.5 hour reaction, the fabric was rinsed, centrifuged, dried and then conditioned before evaluation.

TABLE 3

Anti-pilling performance when cellulase and cutinase were in the bath of second soaping

| 32s TC 65/35 knit | Untreated | Cellulase and Cutinase in the bath of second soaping |
|---|---|---|
| Pilling note (2000R, Martindale) | 1.0 ± 0.2 | 2.2 ± 0.1 |

The untreated group means the fabrics were only dyed without enzyme treatment. In step 3 there was no cellulase added in while in step 4 there were only two ordinary steps of soaping.

Example 4

Modified Pretreatment before Biopolishing with Cellulase Combined in Reactive Dyeing and Cutinase in the Bath after Soaping (in LOM)

Fabric of 32s TC 65/35 knit was cut into 14 cm*14 cm and the pretreatment was conducted at 100° C. and 110° C. with NaOH to scour the TC blended fabric in Lab-O-mat; 2 g/L caustic soda, 1.2 g/L $H_2O_2$, 1 g/L CWA (Huntsman) was added to do scouring and bleaching in one step. Then disperse dyeing (step 2 according to Example 1) which was carried out in Lab-O-mat, followed by reduction clearing and rinse; reactive dyeing (step 3 according to Example 1) of cotton was carried out in a SDL-Atlas LP2 Launder-O-Meter (LOM) and followed by soaping (step 4 according to Example 1).

1.2% owf Cellulase Cellusoft CRC) was combined in reactive dyeing of step 3 and 10 small steel balls were added to each beaker in LOM to provide mechanical action.

Cutinase biopolishing was conducted in the second soaping step as in step 4. It was conducted in LOM with PBS Buffer, LR=10 and Cutinase-1 of 5.6 mg enzyme protein/gram of fabric was added at pH 8 and 80° C. And 0.1 g/L IPE1310 was added. One piece of fabric was placed in each beaker together with 10 small steel balls (diameter 1.5 cm) providing mechanical aid. After 1.5 h the fabric was rinsed with water, centrifuged and dried before evaluation.

TABLE 4

Anti-pilling performance when cellulase in reactive dyeing and cutinase in the bath of second soaping with different pretreatments

| Pretreatment | | | Pilling note (standard Martindale, 2000R) | |
|---|---|---|---|---|
| Temperature (° C.) | Time (min) | NaOH (g/L) | Cellulase | Cellulase + Cutinase |
| 120 | 15 | 2 | 2.7 ± 0.2 | 3.5 ± 0 |
| 110 | 15 | 2 | 2.8 ± 0 | 3.5 ± 0 |
| 110 | 15 | 5 | 2.5 ± 0 | 3.6 ± 0.1 |
| 100 | 15 | 2 | 2.4 ± 0.1 | 2.6 ± 0.1 |
| 100 | 15 | 5 | 2.5 ± 0 | 2.9 ± 0.1 |

TABLE 4-continued

| Anti-pilling performance when cellulase in reactive dyeing and cutinase in the bath of second soaping with different pretreatments | | | | |
|---|---|---|---|---|
| Pretreatment | | | Pilling note (standard Martindale, 2000R) | |
| Temperature (° C.) | Time (min) | NaOH (g/L) | Cellulase | Cellulase + Cutinase |
| 100 | 60 | 5 | 2.4 ± 0.1 | 2.9 ± 0.1 |
| 100 | 60 | 10 | 2.5 ± 0 | 2.8 ± 0 |

It indicated from the table above that the pilling note on 32s TC 65/35 single jersey has been improved from less than 3.0 to 3.5 when the temperature of pretreatment increased from 100 to 110-120° C.

Hence a pretreatment with caustic soda at 110-120° C. will be preferred for biopolishing of polyester/cellulose blended fabrics.

SEQUENCE LISTING

```
<160> NUMBER OF SEQ ID NOS: 1

<210> SEQ ID NO 1
<211> LENGTH: 194
<212> TYPE: PRT
<213> ORGANISM: Humicola insolens

<400> SEQUENCE: 1

Gln Leu Gly Ala Ile Glu Asn Gly Leu Glu Ser Gly Ser Ala Asn Ala
1               5                   10                  15

Cys Pro Asp Ala Ile Leu Ile Phe Ala Arg Gly Ser Thr Glu Pro Gly
            20                  25                  30

Asn Met Gly Ile Thr Val Gly Pro Ala Leu Ala Asn Gly Leu Glu Ser
        35                  40                  45

His Ile Arg Asn Ile Trp Ile Gln Gly Val Gly Gly Pro Tyr Asp Ala
    50                  55                  60

Ala Leu Ala Thr Asn Phe Leu Pro Arg Gly Thr Ser Gln Ala Asn Ile
65                  70                  75                  80

Asp Glu Gly Lys Arg Leu Phe Ala Leu Ala Asn Gln Lys Cys Pro Asn
                85                  90                  95

Thr Pro Val Val Ala Gly Gly Tyr Ser Gln Gly Ala Ala Leu Ile Ala
            100                 105                 110

Ala Ala Val Ser Glu Leu Ser Gly Ala Val Lys Glu Gln Val Lys Gly
        115                 120                 125

Val Ala Leu Phe Gly Tyr Thr Gln Asn Leu Gln Asn Arg Gly Gly Ile
    130                 135                 140

Pro Asn Tyr Pro Arg Glu Arg Thr Lys Val Phe Cys Asn Val Gly Asp
145                 150                 155                 160

Ala Val Cys Thr Gly Thr Leu Ile Ile Thr Pro Ala His Leu Ser Tyr
                165                 170                 175

Thr Ile Glu Ala Arg Gly Glu Ala Ala Arg Phe Leu Arg Asp Arg Ile
            180                 185                 190

Arg Ala
```

The invention claimed is:

1. A method for manufacturing polyester/cellulose blend textile, comprising the following steps:

(a) textile pretreatment, (b) polyester dyeing, (c) cellulosic fiber dyeing, and (d) soaping;

wherein a cellulase is added before, during or after step (b), step (c) and/or step (d); and a cutinase is added before, during or after step (b), step (c) and/or step (d).

2. The method of claim 1, wherein the textile is polyester/cotton blend, or polyester/viscose blend.

3. The method of claim 1, wherein the polyester is polyethylene terephthalate (PET).

4. The method of claim 1, wherein step (a) is conducted at temperature 100-120° C.

5. The method of claim 1, wherein the disperse dyestuff is applied in step (b).

6. The method of claim 1, wherein the reactive dyestuff is applied in step (c).

7. The method of claim 1, wherein a surfactant is applied in step (d) for soaping.

8. The method of claim 1, wherein step (d) is conducted at a temperature of 70-80° C.

9. The method of claim 1, wherein step (d) is followed by a step (e) of treating textile with a softening agent.

10. The method of claim 9, wherein the softening agent is selected from the group consisting of soap, vegetable oil, quaternary ammonium salts with alkyl chains, salts of monoesters and diesters of phosphoric acid and the fatty alcohols.

11. The method of claim 1, wherein the cellulase and the cutinase are added during step (d).

12. The method of claim 1, wherein the cellulase and the cutinase are added after step (d).

13. The method of claim 1, wherein the cellulase and the cutinase are added during step (c).

14. The method of claim 1, wherein the cellulase and the cutinase are added before step (b) and after step (a).

15. The method of claim 1, wherein the cellulase and the cutinase are added before step (c) and after step (b).

16. The method of claim 1, wherein the cellulase is added during step (c) and the cutinase is added during step (d).

17. The method of claim 1, wherein the cellulase is added during step (c) and the cutinase is added right after step (d).

18. The method of claim 1, wherein the blend textile comprises at least 5% (w/w) of polyester.

19. The method of claim 1, wherein the cellulase is an endoglucanase.

* * * * *